United States Patent [19]

Farr

[11] Patent Number: 5,075,617

[45] Date of Patent: Dec. 24, 1991

[54] AUTOMATIC LINE DROP COMPENSATOR

[75] Inventor: Aaron V. Farr, Ogden, Utah

[73] Assignee: Abex Corporation, Newton, Mass.

[21] Appl. No.: 517,834

[22] Filed: May 2, 1990

[51] Int. Cl.[5] ..... G05F 1/20

[52] U.S. Cl. ..... 323/258; 323/343

[58] Field of Search ..... 361/35; 323/258, 263, 323/343; 307/17, 52

[56] References Cited

U.S. PATENT DOCUMENTS 2,333,616 11/1943 Michael ..... 361/35

3,818,321 6/1974 Willner et al. .

3,921,059 11/1975 Birman et al. .

4,454,466 6/1984 Ritter ..... 323/258

*Primary Examiner*—William H. Beha, Jr.

*Attorney, Agent, or Firm*—Thomas S. Baker, Jr.

[57] ABSTRACT

An electronic system connected to a power transmission line having a fluctuating load for automatically providing increments of voltage to the line to supplement voltage losses from the load by sequentially connecting tapes on the windings of a transformer in response to changes in line current.

3 Claims, 4 Drawing Sheets

AUTOMATIC LINE DROP COMPENSATOR

BACKGROUND OF THE INVENTION

In the transmission of electrical alternating current through a power line, resistive and reactive losses occur which result in a loss of the amount of power transmitted through the line. These power losses are directly proportional to the resistance or the reactance of the line where the reactance represents the sum of resistance and the difference between the inductive reactance and the capacitive reactance of the system. Because inductive reactance losses are directly proportional to the frequency of the alternating current these losses become more significant in high-frequency electrical transmission systems such as the 400 Hertz ground power systems utilized to provide power to aircraft.

The power loss in moving current through a line caused by resistance becomes dissipated as heat. In a normal alternating current power transmission line, inductive reactance causes the current to lag the voltage in phase. This causes a standing wave to exist on the power line which results in power seemingly lost because the entire current cannot be delivered to the load. Because alternating current power losses are directly proportional to the square of the current, it has been the practice in the past to raise the transmission voltage in order to cause a corresponding reduction in the current flowing in the transmission line for the same power to be delivered to a load. The disadvantage to this solution resides in the fact that it becomes necessary to provide an extra transformer at each load location to reduce the voltage to a value usable by the load.

As mentioned above, inductive reactance power losses occur in an alternating current system because the current tends to lag the voltage in phase which reduces the power ultimately delivered to the load. One approach to compensate for inductive reactance losses in the past has been to introduce capacitive reactance into the line to compensate for inductive reactance losses. Capacitive reactance in a line causes the voltage to lag the current. If capacitors are installed in series with a line such that the amount of capacitive reactance equals the amount of inductive reactance in the line, the line will be considered resonant and will deliver the maximum possible voltage to the load with the system experiencing only resistive losses. However, this system cannot accommodate resistive losses and does not automatically adjust for changes in line load.

It has been found desirable to provide a system which will automatically compensate for power losses resulting in alternating current transmission systems including those resulting from changing line loads which do not require the installation of a transformer at each load to reduce the transmission voltage to an acceptable level and one which will compensate for resistive line losses as well as inductive reactance of a line without regard to line load.

SUMMARY OF THE INVENTION

An electronic system having a boost transformer connected to a power transmission line having a fluctuating load for automatically adding increments of voltage to the line to supplement voltage losses from the load which comprises: a current transformer connected to the power line to monitor line current and to produce an alternating current signal representative of the line current; rectifier means connected to said current transformer for converting said representative alternating current signal to a direct current voltage signal representative of said line current; sensing means responsive to said voltage signal for sequentially outputting discrete logic signals corresponding to specific values of said voltage signal; switch means connected to multiple taps on the windings of said boost transformer and to said sensing means; wherein one of said switch means is activated in response to said discrete logic signals output by said sensing means to connect one of said boost transformer taps to thereby add an increment of voltage to the line output; wherein said sensing means includes time delay means to enable said sensing means to output the next sequential logic signal and activate another of said switch means to couple the tap of the successive boost transformer winding to said power line prior to extinguishing the previous logic signal and deactivating the previous switch means and causing the previous transformer winding to be decoupled from said line prior to coupling of the successive winding to thereby prevent said primary winding of said boost transformer from being open circuited; and limiting means for limiting the maximum voltage that may be applied to said switch means during the switching operation.

DESCRIPTION OF THE PREFERRED EMBODIMENT

Figure 1:
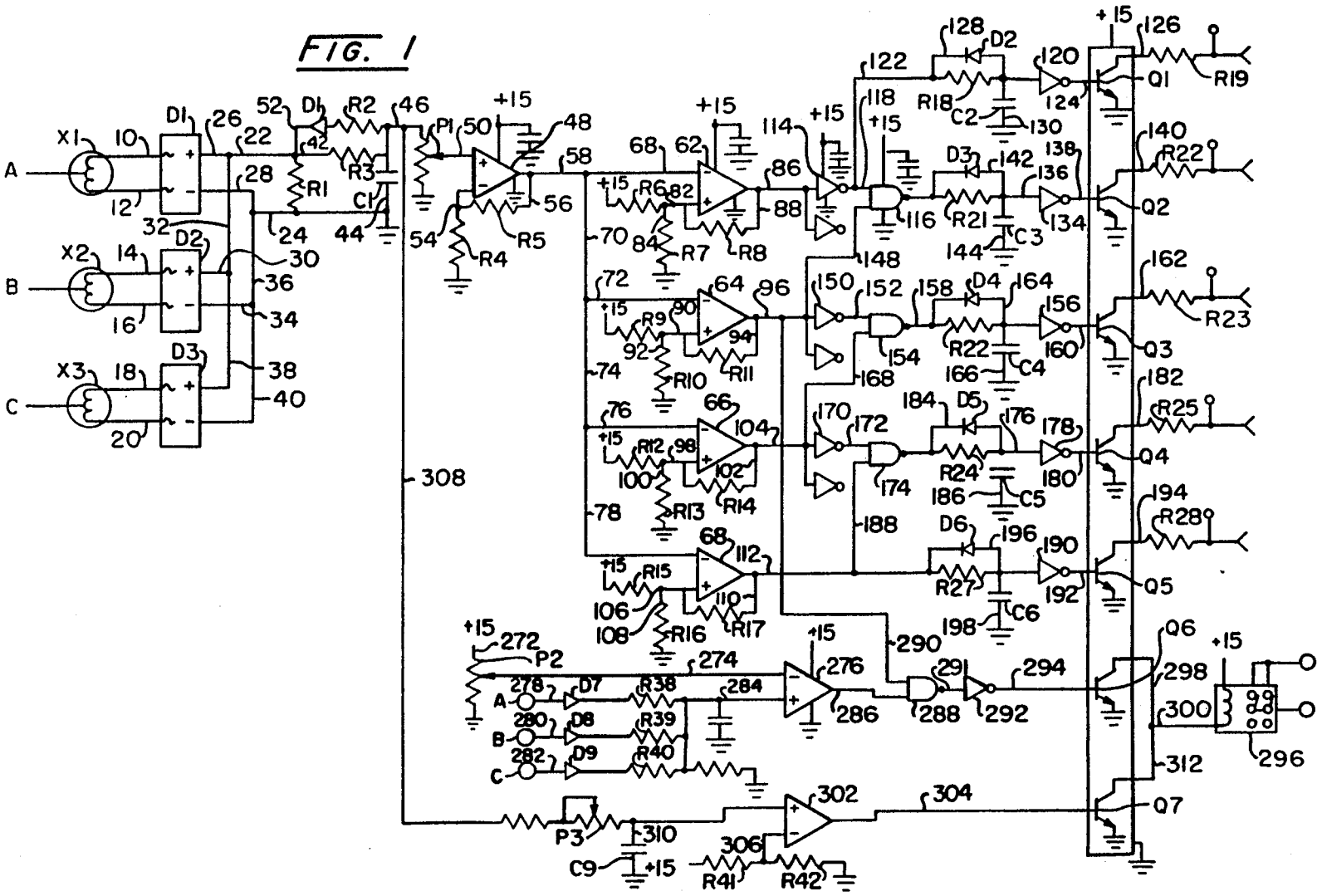
FIG. 1 represents a schematic diagram of the sensing and time delay portion of the circuit of the present invention.

Referring to FIG. 1, lines A, B and C represent each of the phase lines of a three phase alternating current electrical system. Lines A, B and C pass through three current transformers X1, X2 and X3 respectively. In this embodiment of the invention the current transformers have windings with a ratio of 1,000 to 1. Consequently, for each 1,000 ampheres of current seen by the primary winding of the transformer the secondary outputs a current of 1 amphere. The output of the secondary winding of current transformer (X1) is connected to a bridge rectifier (D1) through lines (10 and 12), the output of the secondary winding of current transformer (X2) is connected to a bridge rectifier (D2) through lines (14 and 16) and the output of the secondary winding of current transformer (X3) is connected to a bridge rectifier (D3) through lines (18 and 20).

The bridge rectifiers (D1 through D3) take an alternating current (A.C.) input and provide a direct current (D.C.) voltage output across a resistor (R1) across lines (22 and 24). The output of rectifier (D1) is applied to lines 22 and 24 through output lines (26 and 28). The output of rectifier (D2) is applied to lines 22 and 24 through output lines (30, 32 and 34, 36). Finally the output of rectifier (D3) is applied to lines 22 and 24 through output lines (38, 32 and 40, 36). The DC voltage signals across resistor (R1) are filtered by the combination of a resistor (R3) in line (42) and a capacitor (C1) in line (44) which act to cause a slight delay in providing an increasing DC voltage signal through line (46) connected to one end of the winding of a potentiometer (P1). The wiper arm of potentiometer (P1) is connected to the positive input terminal of a non-inverting amplifier (48) through line (50). It should be noted that the combination of a resistor (R2) and a diode (D1) in line (52) and in parallel with resistor (R3) in line (42) and capacitor (C1) create a condition that allows the circuit to respond more rapidly to a decreasing current than in increasing current. In other words, a decreasing voltage output from the rectifiers (D1 through D3) will be seen at the positive input of non inverting operational amplifier (48) faster than an increasing DC voltage output from the rectifiers (D1 through D3) will be seen at that terminal as capacitor (C1) slows the voltage input.

A resistor (R4) in line (54) connected between ground and the negative input terminal of operational amplifier (48) and a resistor (R5) in line (56) connected between the negative input terminal of operational amplifier (48) and the output of that amplifier at line (58) serve to determine the gain of the input signal of operational amplifier (48). These resistors also serve to buffer the aforementioned input circuitry from a sensing circuit which follows.

SENSING CIRCUITRY

The sensing circuit comprises four operational amplifiers (62 through 68) with hysterisis. The built in hysterisis provides a dead band or zone such that the device will produce a logic high level output at a first voltage applied to the negative input thereof and will change output states from the logic high level to a logic low level at a somewhat lower voltage applied to the negative input terminal thereof. In other words, the device acts as a Schmidt trigger type device and prevents false switching as is well known in the art.

The reference signal output from operational amplifier (48) at line (58) is connected to the negative input terminal of an operational amplifier (62) through line (68), to the negative input terminal of an operational amplifier (64) through lines (70 and 72), to the negative input terminal of an operational amplifier 66 through lines (70, 74 and 76) and to the negative input terminal of an operational amplifier (68) through lines (70, 74 and 78).

A different reference or bias voltage indicative of the amount of current demanded by the load is applied to the positive input of each of the operational amplifiers (62 through 68) such that output of the devices (62–68) goes low in turn with an increasing input voltage at the negative input thereof as described below. Additionally, because the outputs of each of the operational amplifiers (62 through 68) are tied to the positive inputs thereof the devices function as comparators with hysterisis or as Schmidt trigger type devices. Turning to amplifier (62), it may be seen that 15 volts is applied to the positive input of the amplifier through line (82) containing resistor (R6). Line 84 connected to ground and containing resistor (R7) also is connected to the positive input of the amplifier. Accordingly, the value of the voltage divider resistors (R6 and R7) determines the biasing point of the amplifier (62). It should be noted that the output of amplifier (62) at line (86) is connected to the positive input terminal thereof through line (88) containing resistor (R8). This resistor serves to change the reference voltage at the input of the amplifier depending upon whether the output of the device is a logic high signal or logic low signal. In the preferred embodiment of this invention resistors (R6 through R8) are sized such that an input voltage of approximately 1.4 volts at the negative input terminal of amplifier (62) will turn the device on and cause the output at line (86) to assume a logic low level. When this occurs the reference voltage at the positive input terminal of amplifier (62) drops to approximately 1.07 volts and the device will again change state to a logic high output when the voltage at the negative input terminal of amplifier (62) falls below approximately 1.07 volts. Thus, the band between 1.4 volts at the negative input which causes the output of the device to assume a logic low level and 1.07 volts at the negative input of the device which causes the output at line (86) to assume a logic high level serves to prevent false switching of the device.

Operational amplifiers (64 through 68) operate in a similar manner. However, the biasing voltages of each of these devices are different to cause the outputs of the devices to assume a logic low level sequentially as the input voltages gradually increase as stated above. Turning to amplifier (64), 15 volts is applied to the positive input terminal o the device through line (90) containing resistor (R9). Resistor (R10) in line (92) is connected between the positive input terminal and ground. The resistors (R9 and R10) form a voltage divider network which cooperates with resistor (R11) in line (94) connected between the output of the device at line (96) and the positive input of the device to set the biasing points of the amplifier (64). In this embodiment of the invention it has been found preferable to set these biasing points such that a voltage of approximately 2.8 volts at the negative input will cause the output to assume a logic low signal whereas if the voltage at the negative input at line (72) falls below 2.3 volts the output at line (96) will assume a logic high signal.

Turning to operational amplifier (66), 15 volts is applied to the positive input of the device through line (98) containing resistor (R12). Line (100) containing resistor (R13) is connected between the positive input of the device and ground. The voltage divider resistors (R12 and R13) cooperate with feedback resistor (R14) in line (102) connected between the output of amplifier (66) at line (104) and the positive input of the device to set the biasing points of the device 66. The resistor values preferably are chosen such that the device will change state to cause the output at line (104) to assume a logic low value when a voltage of about 4.4 volts is applied to the negative input thereof at line (76) and the output at line (104) will assume a logic high value at line (104) when the voltage at the negative input in line (76) falls below approximately 3.6 volts.

Lastly, 15 volts is applied to the positive input terminal of operational amplifier (68) through line (106) containing resistor (R15). Line (108) containing resistor (R16) is connected between ground and the positive input terminal to form a voltage divider circuit for that terminal. The voltage divider resistors (R15 and R16) cooperate with a feedback resistor (R17) in line (110) connected between the output of amplifier (68) at line (112) and the positive input terminal at line (106) to set the biasing points of the device. Preferably, a voltage of approximately 5.8 volts applied to the negative input terminal at line (78) will function to cause the device to assume a logic low level output at line (112) whereas the output at line (110) will assume a logic high level when the voltage at the negative input falls below 5.1 volts.

Thus, it may be seen that the operational amplifiers (62 through 66) which function as inverters sequentially have their outputs assume a logic low value as the voltage output from inverter (48) and applied to the negative input terminals thereof increases. Additionally, because of the hysterisis built into the devices with the feedback resistors (R8, R11, R14 and R17) false switching is prevented.

LOGIC CIRCUITRY

The outputs of the comparators (62 through 68) are passed to logic circuitry which sequentially activates a series of solid state relays which are connected to various windings of a boost transformer to increase the line voltage as the load increases as described hereinbelow.

Turning again to the output of amplifier (62) at line (86), the output thereof is passed to the input of an inverter (114) the output of which is connected to one input of a two input NAND gate (116) through line (118). The output of inverter (114) at line (118) also is applied to the input of an inverter (120) through line (122) containing resistor (R18). The output of inverter (120) is connected to the base of an NPN transistor (Q1) through line (124). The emitter of transistor (Q1) is tied to ground and the output of the device at line (126) is at the collector thereof. Transistor (Q1) is used as pull down transistor such that if a logic high signal is applied to the base the device is turned on and will conduct whereas if a logic low signal is applied to the base the device will be turned off and will not conduct. The output of transistor (Q1) at line (126) containing resistors (R19 and R20) is connected to the base of an optical isolator (U1) which in turn is connected in serial fashion with a second optical isolator (U2) through line (132) to activate these devices as will be described hereinafter.

A time delay network is inserted between the output of inverter (114) and the base of transistor (Q1). It may be seen that a diode (D2) in line (128) is connected to line (122) in parallel with resistor (R18) and that a capacitor (C2) contained within line (130) has one end connected to ground and the other to line (122) at the input of inverter (120). Capacitor (C2) and Diode (D2) function to provide a rapid turn on time for transistor (Q1) but to slightly delay the turn off of transistor (Q1). Diode (D2) permits the input of inverter (120) to change rapidly from a logic high value to a logic low value whereas resistor (R18) and capacitor (C2) provide a delay when the input of inverter (120) changes from a logic low value to a logic high value. This momentary delay also delays slightly the logic low signal applied to the base of transistor (Q1) which in turn maintains transistor (Q1) in a conducting state for a slightly longer period of time. In other words, transistor (Q1) turns on immediately but experiences a momentary delay in turning off when the output of inverter (62) changes value. Because the logic high signal is applied to the base of one of the transistors (Q1 through Q5) at all times, the delay in removing the logic high level from the base of a transistor as it is turning off ensures that one transistor will be on at all times. Because the transistors (Q1 through Q5) are activating various taps on the primary winding of a boost transformer (211), the time delay circuit ensures that at least one winding will be connected at all times and the primary winding will never have an opportunity to run open circuited.

Referring again to FIG. 1, the output of NAND gate (116) is connected to the input of inverter (134) through line (136) containing resistor (R21). The output of inverter (134) at line (138) connects to the base of transistor (Q2). The emitter of transistor (Q2) is tied to ground and the collector is connected to the base of an optical isolator (U3) through line (140) containing resistors (R22 and R23). A time delay network comprising diode (D3) in line (142) connected in parallel with resistor (R21) and capacitor (C3) in line (144) connected between ground and the input of inverter (134) function to delay the turn off response time for transistor (Q2) in the same way as a similar network described above delays the turn off time of transistor (Q1).

Looking to operational amplifier (64), it may be seen that the output at line (96) is connected to the second input of NAND gate (116) through line (148) and to the input of inverter (150) having its output at line (152) connected to one input of a two input NAND gate (154). The output of NAND gate (154) is connected to the input of an inverter (156) through line (158) containing resistor (R22). The output of inverter (156) at line (160) is connected to the base of transistor (Q3) having its emitter connected to ground and its collector connected to an optical isolator (U4) through line (162) containing resistors (R23 and R24). Again, a time delay network comprising a diode (D4) in line (164) connected in parallel with resistor (R22) in line (158) and a capacitor (C4) connected in line (166) between ground and the input of inverter (156) function to provide a rapid response turn on time and a delayed response turn off time for transistor (Q3).

Turning to operational amplifier (66), the output at line (104) is connected to a second input of NAND gate (154) through line (168) and to one input of inverter (170). The output of inverter (170) at line (172) is connected to one input of a two input NAND gate (174). The output of gate (174) connects to the input of inverter (178 through line (176) containing resistor (R24). The output of inverter (178) at line (180) is connected to the base of transistor (Q4) having its emitter tied to ground and the output at its collector connected to an optical isolator (U5) through line (182) containing resistors (R25 and R26). A time delay network comprising a diode (D5) in line (184) connected in parallel with resistor (R24) and capacitor (C5) in line (186) connected between ground and the input of inverter (178) ensure a rapid turn on time and a delayed turn off time for transistor (Q4).

The output of operational amplifier (68) at line (112) is connected to one input of NAND gate (174) through line (188) and to the input of inverter (190) through resistor (R27). The output of inverter (190) is connected to the base of transistor (Q5) through line (192). The emitter of transistor (Q5) is tied to ground and the output at the collector is connected to the base of an optical isolator (U6) through line (194) containing resistors (R28 and R29). Diode (D6) inserted in line (196) in parallel with resistor (R27) and capacitor (C6) contained within line (198) connected between ground and the input of inverter (190) function to ensure a rapid turn on response time and a delayed turn off response time for the transistor (Q5).

As mentioned previously, the line drop compensator of the present invention operates to automatically increase line voltage as the line load increases by sequentially connecting different windings of the primary coil of a boost transformer to add the appropriate voltage to the line in response to the load of the line. At all times one of the transistors (Q1 through Q5) must be conducting to activate an optical isolator which functions as a switch to turn on SCRs which will connect various primary windings of a boost transformer to add voltage to a load line as will be described hereinbelow.

Operation of Logic Circuitry

Initially, when the three line phases are activated or when the line load is very light the current transformers will output a relatively small alternating current which will result in a small DC voltage applied to the positive input of operational amplifier (48). Consequently, the voltage output at line (58) applied to the negative input terminals of operational amplifiers (62 through 68) will be at a minimum. Resultantly, the outputs of these devices at lines (86, 96, 104 and 112) respectively will be logic high values. The logic high level at line (86) will cause a logic low value at one input of NAND gate (116). Similarly, a logic high value at line (96) will cause a logic low value to occur at one input of NAND gate (154) and a logic high value at line (104) will cause a logic low value to be applied to one input of NAND gate (174). Since two logic high values must be applied to a NAND gate in order for it to have a logic low value output a logic low level will be applied to the bases of transistors (Q2 through Q4). Additionally, a logic high value output at line (112) from amplifier (68) will cause a logic low value to be applied to the base of transistor (Q5). The logic low signals applied to the bases of NPN transistors (Q2 through Q5) will cause these devices to remain off. The logic high level output from amplifier (62) at line (86) will cause a logic low level to be output from inverter (114) and a logic high value to be output from inverter (120) to the base of transistor (Q1). This will force this device to turn on. Thus, a minimum load condition on the line will cause transistor (Q1) to be turned on and transistors (Q2 through Q5) to be turned off.

As the alternating current increases in response to an increased load and the voltage output from operational amplifier (48) at line (58) increases above the 1.41 volts required at the negative input of amplifier (62) the output of the device at line (86) will assume a logic low value. This will cause a logic high level to be applied to the input of NAND gate (116) and a logic low signal to be applied to the base of transistor (Q1). Since the output of amplifier (64) at line (96) remains at a logic high value the two logic high values applied to the inputs of NAND gate (116) will cause the device to change state and produce a logic low value output. This will cause a logic high level to be applied to the base of transistor (Q2) and turn that device on. Because of the time delay circuit comprising diode (D2) and capacitor (C2) the turn off response time for transistor (Q1) will lag the turn on response time for transistor (Q2) such that transistor (Q2) will be turned on momentarily before transistor (Q1) will be turned off.

Similarly, as the voltage output from operational amplifier (48) continues to increase such that the threshold value of 2.8 volts applied to the input of operational amplifier (64) becomes exceeded, that device will change state such that the output at line (96) will assume a logic low value which will cause NAND gate (116) to resume its former logic high value output and a logic high value to be applied to the input of NAND gate (154) at line (152). This logic level combined with the high logic value output from amplifier (66) will cause the output of gate (154) to assume a logic low value and cause transistor (Q3) to be activated. Because of the time delay networks (D3, C3 and D4, C4), transistor (Q3) will have a more rapid turn on response time than the turn off response time for (Q2) and device (Q3) will be activated before device (Q2) becomes deactivated.

As the voltage output from operational amplifier (48) increases to where it exceeds the 4.3 volt required to be input to operational amplifier (66) to cause that device to produce a logic low value output, a logic low value will be applied to NAND gate (154) to cause transistor (Q3) to turn off and a logic high value will be applied to the input from NAND gate (174) at line (172) to cause transistor (Q4) to turn on. Again, the time delay networks comprising diode (D4) and capacitor (C4) and diode (D5 and capacitor (C5) will ensure that transistor (Q4) becomes activated before transistor (Q3) turns off.

Lastly, when the voltage output from operational amplifier (48) exceeds the threshold value of 5.8 volts at the negative input of operational amplifier (68) to cause that device to change state, a logic low signal will be output from that device and to one input of NAND gate (174) to cause transistor (Q4) to turn off. The logic low value output from amplifier (68) will be inverted by inverter (190) and cause transistor (Q5) to turn on. Once again, the time delay networks comprising diode (D5) and capacitor (C5) and diode (D6) and capacitor (C6) will ensure that transistor (Q5) will be turned on before transistor (Q4) has turned off.

From the above, it may be seen that as the line load increases as detected by an increasing alternating current, from a minimum to a maximum value, each of the transistors (Q1 through Q5) will be activated sequentially. Additionally, it may be observed that as the voltage level output from operational amplifier (48) increases and each succeeding transistor becomes activated, time delay networks ensure that the next succeeding transistor becomes activated before the previous transistor becomes deactivated. It should be noted, that as the voltage output from operational amplifier (48) decreases, the transistors (Q1 through Q5) will be sequentially activated and deactivated in reverse order. However, as the succeeding transistors are activated as a result of the decreasing voltage output from operational amplifier (48) the time delay networks ensure that each succeeding transistor will be activated before the previously activated transistor becomes deactivated.

Figure 2:
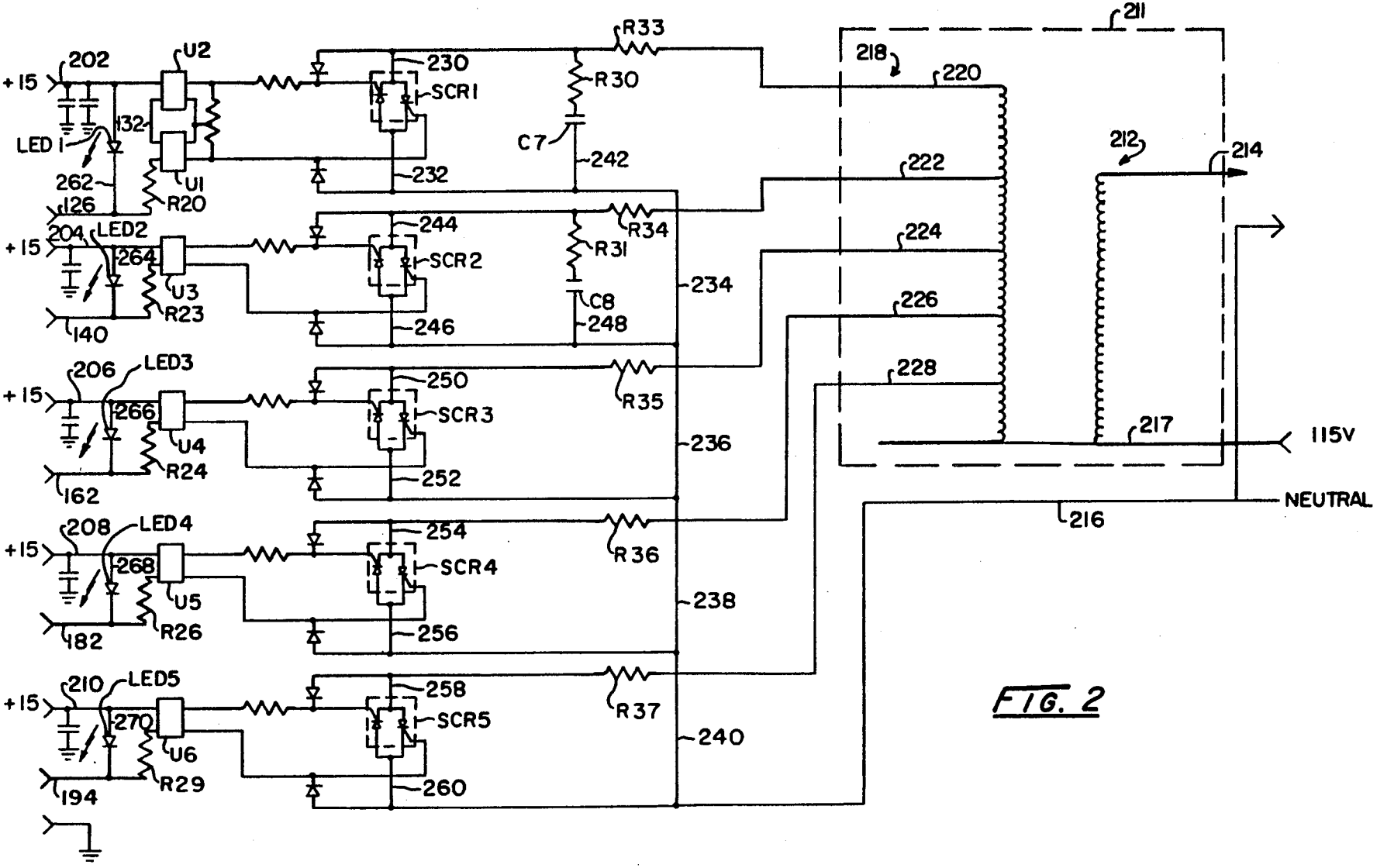
FIG. 2 represents the switching and transformer portion utilized to boost the voltage in one phase of a three phase alternating current signal in the preferred embodiment of the invention.

Turning to FIG. 2, it may be observed that a positive 15 volts is input to optical isolator (U2) through line (202) and optical isolator (U2) is connected in series with a second optical isolator (U1) through line (132). When transistor (Q1) is activated a circuit is established and the optical isolators (U1 and U2) are turned on. The optical isolators (U1 and U2) contain internal light emitting diodes which activate a pair of silicon controlled rectifiers within a device referred to collectively as SCR1. The optical isolators contain a zero crossing sensing circuit which forward biases one of the SCRs within SCR1 during half of the alternating current cycle and forward biases the other SCR within SCR1 during the opposite half of the alternating current cycle.

In a similar manner, a positive 15 volts is applied to optical isolator (U3) through line (204) and that device engergizes a pair of silicon controlled rectifiers on alternate halves of the alternating current cycle in a device referred to as SCR2. Additionally, a positive 15 volts is applied through line (206) to optical isolator (U4) which energizes a pair of silicon controlled rectifiers as mentioned above within a device referred to as SCR3. Likewise, a positive 15 volts at line (208) is applied to optical isolator (U5) which serves to energize a pair of silicon controlled rectifiers within device SCR5. Lastly, a positive 15 volts at line (210) is applied to optical isolator (U6) which in turn controls a pair of SCRs within device identified as SCR5.

Keeping in mind that FIG. 2 depicts a circuit for use with one phase of a three phase alternating current system, 115 volts AC is input at lines 216 and 217 to the secondary winding (212) of a boost transformer (211) having an output to load at lines (214) and (216). The line drop compensator of the present invention operates by incrementally adding voltage from the primary section (218) of boost transformer (211) to the output lines (214 and 216) as the line load increases. Of course the compensator also reduces voltage to lines (214 and 216) as the load drops. The boost transformer (211) has a primary winding (218) having five taps 220, 222, 224, 226 and 228 which when selected add 5 volts, 10 volts, 15 volts, 20 volts and 25 volts respectively to the output lines (214 and 216). Transformer tap 220 is connected to one side of silicon controlled relay (SCR1) through line (230) and resistor (R33). The opposite side of the device is connected to neutral through lines (232 through 240). When SCR1 is energized, 5 volts is added to the line voltage to produce an output voltage of 120 volts at lines (214 and 216). Resistor (R30) and capacitor (C7) are added to line (242) to help extinguish SCR1.

Transformer tap (222) is connected to one side of SCR2 through line (244) and resistor (R34). The other side of SCR2 is connected to neutral through lines (246 and 236 through 240). When SCR2 becomes energized, a positive 10 volts is added to the line voltage at lines (214 and 216) to produce a 125 volt output. A snubber network comprising resistor (R31) and capacitor (C8) in line (248) is connected between tap 222 and output line (246) to help extinguish SCR2. This snubber network and the snubber network (R30), C7 associated with SCR1 are required because of transients created by the switching in the lower voltage ranges.

Transformer tap (224) is connected to one side of SCR3 through line (250) and resistor (R35). The opposite side of SCR3 is connected to neutral through line (252), line (238) and line (240). When SCR3 is activated to connect tap (224), 15 volts is added to the output voltage at lines (214 and 216) to produce a line voltage of approximately 130 volts.

A fourth transformer tap (226) is connected to one side of SCR4 through line (254) and resistor (R36). The other side of SCR4 is connected to neutral through lines (256 and 240). Connecting tap (228) in boost transformer (211) adds approximately 20 volts to the line voltage to provide approximately 135 volts at the output lines (214 and 216).

The final tap (228) of the primary winding (218) of boost transformer (211) is connected to one side of SCR5 through line (258) and resistor (R37). The opposite side of SCR5 is connected to neutral through line (260). Connecting tap (228) adds approximately 25 volts to the line output to produce a total voltage of approximately 140 volts across the output lines (214 and 216). The 25 volts are added when the line load is the greatest.

As described above, a resistor (R33 through R37) has been placed in series in each of the transformer taps (220 through 228) going to the silicon controlled rectifier devices (SCR1 through SCR5). As mentioned previously, during the period of time the system changes from activating one SCR to the next, they are both energized for a very short period of time to ensure the boost transformer does not run open-circuited. This condition produces, in effect, a shorted section of the primary winding (218) of the boost transformer (211) which causes a very high peak current to flow. Such a current may approach 2000 amps. Although this peak current occurs for a very short period (half cycle peak), such a high current causes some distress to the SCRs (SCR1 through SCR5) which typically are rated for only 1500 amperes per one-half cycle. The resistors (R33 through R37) serve to reduce the peak current to approximately 1000 amperes which would be within the normal operating capabilities of the SCRs (SCR1 through SCR5).

It may be observed that a light emitting diode (LED1) is inserted in line (262) between the 15 volt line (202) and line (126) in parallel with the optical isolators (U1 and U2). Light emitting diode (LED1) is energized when optical isolators (U1 and U2) are activated to energize silicon controlled rectifier (SCR1). Similarly, a light emitting diode (LED2) in line (264) between line (204) connected to a 15 volt source and line (140) indicates the activation of optical isolator (U3). Also, a light emitting diode (LED3) in line (266) connected in parallel with optical isolator (U4) between lines (206 and 162) serves to indicate when that device has been activated. The operation of optical isolator (U5) is confirmed when light emitting diode (LED4) in line (268) connected in parallel with the device between lines (208 and 182) is energized. Lastly, light emitting diode (LED5) in line (270) connected between lines (210 and 194) in parallel with optical isolator (U6) indicates the activation of that device. Thus, the light emitting diodes (LED1 through LED5) serve to provide a visual indication as to the amount of voltage the boost transformer (211) is adding to the line voltage output.

From the above, it may be seen that in the preferred embodiment described above the line drop compensator of the present invention monitors the alternating current draw of a load in a three phase system. As the line load increases, the operational amplifiers (62 through 68) sequentially activate transistors (Q1 through Q5) to sequentially connect taps of the primary winding (218) of boost transformer (211) to increase the line voltage of the system. Additionally, the system includes time delay circuits to ensure that one tap of the primary winding remains connected to the output line at all times to prevent an open circuited condition within the primary winding.

The line drop compensator circuit of the present invention also includes an over-voltage protection circuit which will disable the entire output of the device in the event the output voltage of the device exceeds a set amount and the sensing circuit indicates a light line load condition and an over current circuit which will interrupt the output of the device in the event the load demands a greater output than the boost transformer can accommodate.

Turning again to FIG. 1, a positive 15 volts is applied to the winding of a potentiometer (P2) through line (272). The wiper arm of potentiometer (P2) at line (274) is connected to the negative input terminal of a non-inverting operational amplifier (276). In the present invention it has been found desirable to adjust potentiometer (P2) to provide a reference voltage of approximately 6.9 volts. The three output phase voltages A, B and C at lines (278 through 282) are applied to the positive input terminal of amplifier (276) through line (284). Diodes D7, D8 and D9 in lines (278, 280 and 282) respectively rectify the voltages. Resistors (R38, R39 and R40) in these lines isolate the three phases and provide a voltage divider network such that a logic high signal will be output from operational amplifier (276) at line (286) to one input of a two input NAND gate (288) in the event the voltage output of the line drop compensator exceeds approximately 131 volts. Line (290) connected to the output of operational amplifier (64) at line (96) also connects to one input of NAND gate (288). This input receives a logic high signal if the line load is sufficiently light that inverter (64) does not change state. When this occurs the output of NAND gate (288) at line (291) assumes a logic low value which is applied to the input of an inverter (292). This device outputs a logic high signal at line (294) which is applied to the base of transistor (Q6) to turn that device on. The output of the device at the collector is connected to a relay (296) through lines (298 and 300). When transistor (Q6) is activated the current flow causes relay (296) to interrupt the output to the load through lines (214 and 216).

Operational amplifier (302) having an output at line (304) to the base of transistor (Q7) monitors the voltage produced by the current flowing through resistor (R1). A voltage divider circuit including resistors (R41 and R42) is connected to the negative input of operational amplifier (302) through line (306) to provide a reference value at which the current overload will cause the amplifier to output a logic high signal to line (304). The voltage output by resistor (R1) is applied to the positive input of operational amplifier (302) through line (308) containing a potentiometer (P3). Potentiometer (P3) in combination with capacitor (C9) which is contained within line (310) connected between the positive input of amplifier 302 and ground serve to set the time constant for the response of amplifier (302). When an overcurrent situation develops such as from a short circuit or from a load greater than the transformer is designed to handle, the output of amplifier (302) will obtain a logic high value which will be applied to the base of transistor (Q7) to turn that device on. This will cause the output of the device at the collector to be connected to relay (296) through lines (312 and 300). When transistor (Q7) has been energized, relay (296) trips and interrupts the power output to the load via lines (214 and 216).

From the above, it may be seen that the preferred embodiment of the line drop compensator of the present invention sequentially connects various taps in the primary winding of a boost transformer to change the voltage output to a load in response to changes of the load by monitoring the alternating current demands of the system. Additionally, the device includes time delay networks to ensure that a tap for the primary winding of the boost transformer remains connected in the circuit during switching. Additionally, peak voltage limiting means are provided to limit the peak voltages seen by the silicon controlled relay switching devices during switching. Lastly, over voltage and over current protection means are incorporated within the system.

Figure 1A:
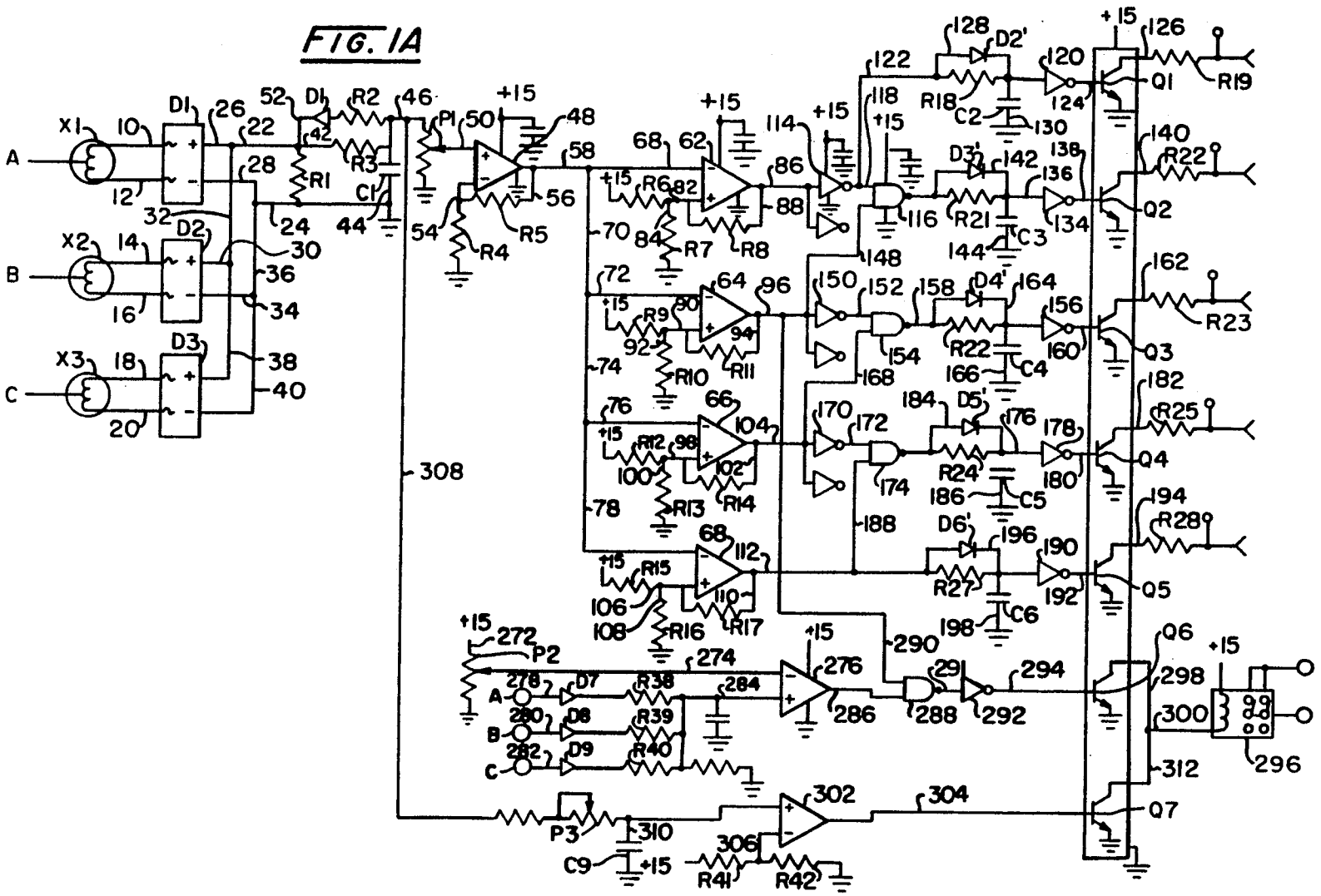
FIG. 1A illustrates the sensing and time delay portions of a circuit of the alternate embodiment of the invention the remainder of the circuit of which is depicted in FIG. 3.
Figure 3:
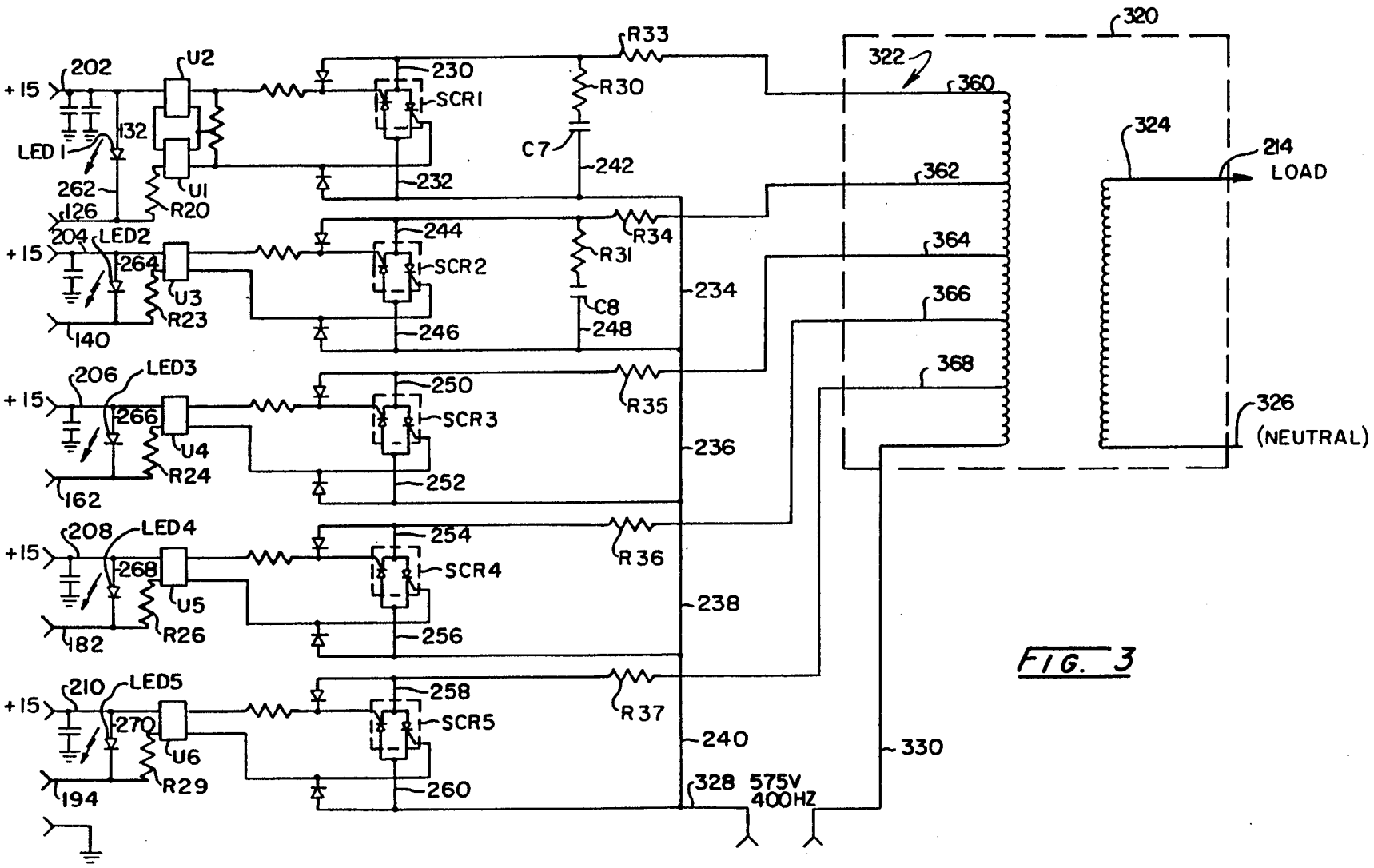
FIG. 3 represents an alternate embodiment of the invention wherein a step down transformer is utilized in place of the boost transformer illustrated in connection with the preferred embodiment of the invention.

An alternate embodiment of the line drop compensator of the present invention may be seen by referring to FIGS. 1A and 3. This embodiment differs from the preferred embodiment in two ways. First it utilizes a step-down transformer as opposed to a boost transformer. Secondly, the time delay means must be modified to ensure that at any given time only one tap of the primary winding of the transformer is connected to the stepped up voltage input. Thus, the time delay means must be modified to function such that one primary winding tap is disconnected from the stepped up voltage input prior to the connection of the next successive primary winding voltage tap to that input. In FIGS. 1A and 3, those components which are identical to the components utilized in connection with the preferred embodiment of the invention utilizing boost transformer shown in FIGS. 1 and 2 will be identified by identical numbers. Different elements or items connected differently will be identified by different numbers. Turning to FIG. 3, a step-down transformer (320) has been substituted for the boost transformer (211) in the preferred embodiment. Transformer (320) includes a primary winding (322) and a secondary winding (324). Secondary winding (324) is connected to neutral at line (326) and to the load at line (214). The silicon controlled rectifiers SCR1-SCR5 are connected to taps (360-368) on the primary winding (322) in a similar fashion to the way they were connected to the taps on the primary winding (218) of the boost transformer (211).

A stepped up voltage input which may approximate 575 volts at 400 hertz are applied to the primary winding (322) through lines 328 and 330. Depending upon which of the optical isolators (U1 through U6) and silicon controlled rectifier switches (SCR1 through SCR5) are activated to thereby connect a tap on the primary winding (322) of the transformer (320) to the stepped up voltage input, a voltage will be applied to the secondary winding (324) to thereby output a voltage to the load at lines 214 and 326. In this embodiment of the invention, if SCR1 is activated 115 volts are output to the load. Similarly, activation of silicon controlled rectifier SCR2 outputs 120 volts, activation of silicon controlled rectifier SCR3 outputs 125 volts, activation of silicon controlled rectifier SCR4 outputs 130 volts and activation of silicon controlled rectifier SCR5 outputs 135 volts to the load.

As previously mentioned, in this embodiment in which a step-down transformer (320) is substituted for the boost transformer (211) in the preferred embodiment, a modification must be made to the time delay network in the logic circuitry illustrated in FIG. 1. The modification becomes necessary to ensure that only one tap of the primary winding is connected to the stepped up voltage input at any time. This modification may be seen by referring to FIG. 1A. To accomplish the required modification, the direction of diode D2 in line 128, diode D3 in line 142, diode D4 in line 164, diode D5 in line 184 and diode D6 in line 196 shown in FIG. 1 are reversed and identified by identical primed numbers in FIG. 1A. When this modification is made it enables the transistors (Q1 through Q5) to be deactivated instantaneously when the respective operational amplifiers 62, 64, 66, 68 change state. At the same time, this modification will delay the response of the transistors Q1 through Q5 to a logic level low output from inverter (114), a logic level low output from gates 116, 154, 174, and a logic level low from amplifier (68).

With the modifications mentioned above, the second embodiment of the invention functions in substantially the same manner as the preferred embodiment to adjust the voltage output to a load in response to changes in a load.

Operation of the logic circuitry with the modifications noted above with respect to the second embodiment of the invention may be seen by referring again to FIG. 1A. In this embodiment of the invention, the current transformers X1, X2 and X3 monitor the load of the three line phases A, B and C and apply a DC voltage output to the positive input of operational amplifier (48). Where the line loads are minimal, the voltage output from amplifier (48) at line (58) and applied to the negative input terminals of operational amplifiers (62 through 68) will be at a minimum. As a result, the outputs of these devices at lines 86, 96, 104 and 112 respectively will be logic high values. The logic high level at line 86 will cause a logic low value at one input of NAND gate 116. A similar logic high value at line 96 will cause a logic low value to occur at one input of NAND gate (154) and a similar logic high value at line (104) will cause a logic low value to be applied to one input of NAND gate (174). Since at least one input of the NAND gates (116, 154 and 174) has a logic low value the devices will not change state and will have a logic high value output. Consequently, a logic low level will be applied to the bases of transistors Q2 through Q4 which will cause the devices to remain in a nonconducting state.

It should be noted that a logic high value output at line (112) from amplifier (68) will cause a logic low value to be applied to the base of transistor (Q5) to cause that device to remain in a nonconducting state. A logic high level output from amplifier (62) at line (86) will cause a logic low level to be output from inverter (114) and a logic high value to be output from inverter (120) to the base of transistor (Q1). This will cause this device to conduct. From this it may be seen that at a minimum load condition for the three phases transistor (Q1) will be turned on and transistors (Q2 through Q5) will be turned off.

As the load in the three phase lines A, B and C increases the voltage output from operational amplifier (48) at line 58 will increase above the 1.41 volts required at the negative input of amplifier (62) to cause the output of the device to change state and the output at line (86) will assume a logic low value. This will cause a logic high level to be applied to the input of NAND gate (116) and a logic low value to be applied to the base of transistor (Q1). Since the output of amplifier (64) at line (96) remains at a logic high value the two logic high values applied to the inputs of NAND gate (116) will cause the device to change state and produce a logic low value output. This will cause a logic high value to be applied to the base of transistor Q2 to thereby cause that device to conduct. As mentioned previously, in the second embodiment of the line drop compensator of the present invention diode (D2) in line 128, diode (D3) in line 142, diode (D4) in line 164, diode (D5) in line 184 and diode (D6) in line 196 shown in FIG. 1 have been reversed in direction as may be seen by referring to FIG. 1A. Consequently, the time delay circuit comprising diode D2' will cause the turnoff response time for transistor (Q1) to lead the turn on response time for transistor (Q2) such that transistor (Q1) will be turned off prior to transistor (Q2) being turned on.

Referring momentarily to FIG. 3, it may be seen that a stepped up voltage input which may approximate 575 volts at 400 hertz is input to the primary winding (322) of step down transformer (320) through lines (328 and 330). Depending upon the tap selected of the primary transformer, a voltage ranging from between 115 volts to 135 volts will be output to the load at line (214). It may be seen also that when a selected tap has been disconnected from the power input source the output of the primary winding falls to zero. Thus, during the time when winding is disconnected from the input power source the power output of the primary winding starts to fall and the output will be regained when the next successive tap has been engaged.

As the voltage output from operational amplifier (48) continues to increase such that the threshold value of 2.8 volts applied to the input of operational amplifier (64) becomes exceeded, that device will change state such that the output at line (96) will assume a logic low value which will cause NAND gate (116) to assume its former logic high value output and a logic high value will be applied to the input of NAND gate (154) at line (152). This logic level combined with the logic high value output from amplifier (66) will cause the output of gate (154) to assume a logic low value and cause transformer (63) to be activated. Because of the time delay networks comprising diode D3', capacitor C3, diode D4' and capacitor C4 transistor (Q2) will have a more rapid turnoff response time than the turn on response time for transistor (Q3) and thus transistor (Q2 will be deactivated before transistor (Q3) begins conducting.

As the voltage output from operational amplifier (48) increases to the point at which it exceeds the 4.3 volt threshold of amplifier (66) to cause that device to change state, a logic low value will be applied to NAND gate (154) to cause transistor (Q3) to become deactivated and a logic high value will be applied to the input of NAND gate (174) at line (172) to cause transistor (Q4) to conduct. Of course, the time delay networks comprising diode D4', capacitor (C4) and diode (D5), and capacitor (C5) will cause transistor (Q3) to turn off prior to transistor (Q4) conducting.

Finally, when the voltage output from operational amplifier (48) exceeds the threshold value of 5.8 at the negative input of amplifier (68) to thereby cause that device to change state, a logic low signal will be output from that device to one input of NAND gate (174) to cause transistor (Q4) to turn off. The logic low value output from amplifier (68) will be inverted by inverter (190) and cause transistor (Q5) to turn on. Of course, the time delay networks comprising diode D5', capacitor (C5) and diode D6' and capacitor (C6) will ensure that transistor (Q4) will be turned off before transistor (Q5) has been turned on.

It may be seen that in the aforementioned alternate embodiment of the invention as the line load increases as detected by an increasing alternating current, from a minimum to a maximum value, each of the transistors (Q1 through Q5) will be activated sequentially. Additionally, it may be observed that as the voltage level output from operational amplifier (48) increases and each succeeding transistor become activated, time delay networks ensure that the previous transistor will be deactivated prior to the next succeeding transistor becoming activated. Of course, as the voltage output from operational amplifier (48) decreases, the transistors (Q1 through Q5) will be deactivated sequentially and activated in reverse order. However, the time delay networks continue to ensure that the activate transistor will be activated prior to the next succeeding transistor becoming activated.

Turning again to FIG. 3, it may be seen that as the transistors (Q1 through Q5) are activated sequentially, the corresponding optical isolators (U1 through U6) are activated to in turn activate corresponding silicon controlled relays (SCR1 through SCR5) to thereby connect the respective taps (360 through 368) of the primary winding (322) of step down transformer (320) to the voltage input at lines (328 and 330). When a tap has been connected a corresponding voltage will be output to the secondary winding (324) and to the load through line (214) in a well known manner.

Thus, it may be seen that the second embodiment of the invention provides an alternate means for sensing changes in line load utilizing a current transformer in each phase of a three phase system and thereafter adjusting the output of the device to match the load.

Since certain changes may be made in the above-described system, apparatus and method without departing from the scope of the invention herein, it is intended that all matter contained in the description thereof or shown in the accompanying drawings shall be interpreted as illustrative and not in a limiting sense.

I claim:

1. An electronic system having a boost transformer connected to a power transmission line having a fluctuating load for automatically providing increments of voltage to the line to supplement voltage losses from the load which comprises:

a current transformer connected to the power line to monitor line current and to produce an alternating current signal representative of the line current;

rectifier means connected to said current transformer for converting said representative alternating current signal to a direct current voltage signal representative of said line current;

sensing means responsive to said voltage signal for sequentially outputting discrete logic signals corresponding to specific value of said voltage signal;

switch means connected to multiple taps on the windings of said boost transformer and to said sensing means;

wherein one of said switch means is activated in response to said discrete logic signals output by said sensing means to connect one of said boost transformer taps to thereby add an increment of voltage to the line output;

wherein said sensing means includes time delay means to enable said sensing means to output the next sequential logic signal and activate another of said switch means to couple the tap of the successive boost transformer winding to said power line prior to extinguishing the previous logic signal and deactivating the previous switch means and causing the previous transformer winding to be decoupled from said line prior to coupling of the successive winding to thereby prevent said primary winding of said boost transformer from being open circuited; and snubbing means for limiting the maximum voltage that may be applied to said switch means during the switching operation.

2. An electronic system connected to a power transmission line having a fluctuating load for automatically adjusting voltage output to line to supplement voltage losses from the load which comprises:

a step down transformer having a primary winding and a secondary winding connected to the load;

a current transformer connected to the power line to monitor line current and to produce an alternating current signal representative to the line current;

rectifier means connected to said current transformer for converting said representative alternating current signal to a direct current voltage signal representative of said line current;

sensing means responsive to said voltage signal for sequentially outputting discrete logic signals corresponding to specific values of said voltage signal;

switch means connected to multiple taps on the primary winding of said down transformer and to said sensing means;

wherein one of said switch means is activated in response to said discrete logic signals output by said sensing means to connect one of said primary winding transformer taps to thereby provide a voltage output to the secondary winding;

wherein said sensing means includes time delay means to enable said sensing means to extinguish a previous logic signal and deactivate a previous switch means to cause the previous transformer winding to be decoupled from said voltage input prior to outputting the next sequential logic signal activating another of said switch means to couple the tap of the successive primary transformer winding to said voltage input line to thereby prevent two of said primary winding taps to said step down transformer from being connected to the voltage input simultaneously.

3. The electronic system of claim 2 further comprising snubbing means for limiting the maximum voltage that may be applied to said switch means during the switching operation.

* * * * *